US011672714B2

(12) United States Patent
Choi et al.

(10) Patent No.: US 11,672,714 B2
(45) Date of Patent: Jun. 13, 2023

(54) ELECTRIC WHEELCHAIR

(71) Applicant: LG ELECTRONICS INC., Seoul (KR)

(72) Inventors: Haemin Choi, Seoul (KR); Wondong Do, Seoul (KR); Jaebeom Im, Seoul (KR); Eulpyo Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 738 days.

(21) Appl. No.: 16/668,704

(22) Filed: Oct. 30, 2019

(65) Prior Publication Data

US 2020/0237590 A1 Jul. 30, 2020

(30) Foreign Application Priority Data

Jan. 29, 2019 (KR) ..... 10-2019-0011267

(51) Int. Cl.
*A61G 5/04* (2013.01)
*A61G 5/12* (2006.01)
*A61G 5/10* (2006.01)

(52) U.S. Cl.
CPC ..... *A61G 5/125* (2016.11); *A61G 5/04* (2013.01); *A61G 5/1051* (2016.11); *A61G 2203/14* (2013.01); *A61G 2203/20* (2013.01)

(58) Field of Classification Search
CPC ..... A61G 5/125; A61G 5/04; A61G 5/1051; A61G 2203/14; A61G 2203/20
See application file for complete search history.

(56) References Cited

U.S. PATENT DOCUMENTS 3,580,636 A * 5/1971 Setto ..... G05G 1/62 244/234
4,556,997 A * 12/1985 Takamiya ..... A61G 5/125 600/16
5,491,462 A * 2/1996 Cecchi ..... A63F 13/24 74/471 XY
6,095,268 A * 8/2000 Jones, Jr. ..... B60L 15/007 180/65.6
6,176,335 B1 * 1/2001 Schaffner ..... A61G 5/125 180/907

(Continued)

FOREIGN PATENT DOCUMENTS

JP 2500231 3/1996
JP 6201486 9/2017

(Continued)

OTHER PUBLICATIONS

Korean Office Action dated Oct. 29, 2020 issued in Application No. 10-2019-0011267.

*Primary Examiner* — Emma K Frick
(74) *Attorney, Agent, or Firm* — KED & Associates LLP

(57) ABSTRACT

An electric wheelchair according to an embodiment of the present disclosure includes a frame configured to support a seat, a driver configured to be coupled to a lower portion of the frame, armrests configured to be coupled to both sides of the frame, and a controller configured to be detachably coupled to the armrest, in which the controller is coupled so as to shield an opening formed in the armrest and is electrically connected to a connector located inside the armrest. The wheelchair includes a robot.

15 Claims, 9 Drawing Sheets

(56) References Cited

U.S. PATENT DOCUMENTS

| | | | | |
|---|---|---|---|---|
| 6,428,103 | B1 * | 8/2002 | Hong | A61G 5/14 297/340 |
| 7,032,703 | B2 * | 4/2006 | Wulfert | B60R 11/0235 297/344.13 |
| 7,458,439 | B2 * | 12/2008 | Catton | B60N 2/767 248/125.8 |
| 7,797,918 | B2 * | 9/2010 | Drake | A01D 34/82 180/315 |
| 8,362,872 | B2 * | 1/2013 | Clapperton | A61G 5/04 340/3.1 |
| 8,775,001 | B2 * | 7/2014 | Phillips | B60L 50/52 701/22 |
| 10,082,788 | B1 * | 9/2018 | Dengel | B63H 25/02 |
| 10,386,936 | B2 * | 8/2019 | Stucki | G06F 3/0238 |
| 10,881,562 | B2 * | 1/2021 | Norris | A61G 5/1056 |
| 11,123,243 | B2 * | 9/2021 | Wada | A61G 5/1089 |
| 11,505,917 | B2 * | 11/2022 | Graham | E02F 9/265 |
| 2007/0074917 | A1 * | 4/2007 | Jaenke | F16B 2/065 180/65.1 |
| 2014/0083225 | A1 * | 3/2014 | Downs | B60K 35/00 74/471 XY |

FOREIGN PATENT DOCUMENTS

| | | |
|---|---|---|
| KR | 10-2012-0060035 | 6/2012 |
| KR | 10-2018-0052047 | 5/2018 |

* cited by examiner

ELECTRIC WHEELCHAIR

CROSS-REFERENCE TO RELATED APPLICATIONS

The present application claims priority under 35 U.S.C. 119 and 35 U.S.C. 365 to Korean Patent Application No. 10-2019-0011267 (filed on Jan. 29, 2019), which is hereby incorporated by reference in its entirety.

BACKGROUND

The present disclosure relates to an electric wheelchair.

In general, a wheelchair refers to a chair with wheels so that a person with a disability, an elderly person, a person who is not free with a leg, or a person who is uncomfortable can move to the desired place while sitting.

Such wheelchairs are classified into manual wheelchairs in which a user manually drives wheels and electric wheelchairs in which wheels are driven by an electric motor according to a driving method thereof.

In general, the manual wheelchair has a structure which is provided with wheels on both sides of a seat portion to allow the user to ride and a ring member is provided to rotate the wheels, and the overall size of the manual wheelchair can be reduced by the simple operation of folding the seat using a separate lever.

In addition, the electric wheelchair has a structure which is provided with wheels on both sides of a seat portion to allow the user to ride and a drive motor configured to be capable of rotating the wheels and can be driven by operating a separate controller.

As the related art, Korean Patent Publication No. 10-2018-0052047 (May 17, 2018) discloses a joystick-type controller assembly of an electric wheelchair.

The electric wheelchair disclosed in the related art can freely change the position of the joystick-type controller and can rotate the joystick-type controller by using a rotation portion and a connecting member, thereby being capable of being used while optimizing the position of the controller according to the user's body or disability environment.

However, the electric wheelchair disclosed in the related art has the following problems.

First, there is a problem that the electric wheelchair of the related art cannot provide the necessary information when driving. In other words, there is a problem that the driving is dangerous because the current speed, the remaining battery amount, the dangerous situation warning when driving, or the like cannot be provided in real-time.

Second, since the joystick-type controller of the related art has a structure in which an electric wire connected to the controller is exposed to the outside, there are problems that the wire is caught by the body and the electrical short circuit occurs due to leakage in rain rainy weather.

SUMMARY

The present disclosure has been proposed to improve the above problems, and an object of the present disclosure is to provide an electric wheelchair in which the controller can be selectively installed on any one of both armrest units of the electric wheelchair.

Another object of the present disclosure is to provide an electric wheelchair in which the electric wire of the controller installed in the armrest unit is not exposed to the outside.

Still another object of the present disclosure is to provide an electric wheelchair in which a controller can be easily installed in the armrest unit.

Still another object of the present disclosure is to provide an electric wheelchair that can be provided with the information necessary for driving through a display and can also be driven according to the information.

Still another object of the present disclosure is to provide an electric wheelchair in which the operation feeling of the joystick can be improved.

Still another object of the present disclosure is to provide an electric wheelchair that can be provided with a robot.

An electric wheelchair according to an embodiment of the present disclosure for achieving the above objects includes a frame, and a drive unit and an armrest unit, which are coupled to the frame. In particular, the armrest unit is provided with a controller detachably coupled, and thus there is an advantage that both the right-handed and left-handed can effectively use the controller.

In addition, the controller is coupled to shield the opening portion formed in the armrest unit, and electrically connected to the connector located inside the armrest unit, so that the electric wire connected to the controller is not exposed to the outside, and thus there are advantages that the outer appearance of the product is beautiful and the electric short circuit due to leakage in rainy weather is prevented in advance.

According to an embodiment of the present disclosure, the armrest unit includes a frame body on which the connector is disposed and a frame cover coupled to an upper portion of the frame body and forming an inner space in which the connector is received.

At this time, since an opening portion is formed in the frame cover to expose the connector to the outside, there is an advantage that the electric wire connected to the controller can be easily connected to the connector.

In addition, the frame body may include a fastening boss into which the protrusion portion provided in the controller is inserted, so that the controller may be more stably installed in the armrest unit.

The controller may include a joystick unit coupled to the armrest unit, a button unit coupled to the front of the joystick unit, and a display unit coupled to the front of the button unit. Therefore, the user can be provided with the information necessary for driving through the display and the electric wheelchair can be driven according to the information.

In addition, the joystick unit may include a joystick housing that shields the opening portion of the armrest unit, a control box disposed in an inner space of the armrest unit corresponding to an inner side of the joystick housing, and a joystick lever connected to the control box and disposed outside the joystick housing.

At this time, the control box may include a box portion provided with an electronic device, a box flange provided above the box portion, and a shaft portion extending upward from a center of an upper surface of the box portion and inserted into the joystick lever.

The shaft portion may be inserted into the joystick lever through the joystick housing.

In addition, the electric wheelchair further includes a fixing plate to which the box flange is fixed, and the fixing plate may be fixed to an inner surface of the joystick housing.

In addition, the fixing plate may include a through-hole through which the shaft portion passes, and a hole through which a protrusion portion provided in the joystick housing passes.

The joystick housing may include an upper surface disposed in the opening portion of the armrest unit, a front surface extending downward from a front end portion of the upper surface, and a pair of side surfaces extending downward from both sides of the upper surface, respectively, and the upper surface may be formed with an opening portion through which the shaft portion passes.

In addition, the joystick housing may be provided with a protrusion portion protruding downward from the inner surface of the upper surface, and a fastening boss into which the protrusion portion is inserted may be formed in the frame body.

The joystick lever may include a lever body disposed above the opening portion of the armrest unit and a lever handle extending upward from the lever body, and the shaft portion may be inserted into the lever handle through the joystick housing.

In addition, the electric wheelchair may further include a lever guide provided on a bottom surface of the lever body, and a guide hole through which the shaft portion passes may be formed inside the lever guide.

At this time, the guide hole is formed in an octagonal shape, and the center axis of the shaft portion and the center of the guide hole coincide, so that the joystick lever can be operated not only in four directions, that is front, rear, left, and right directions, but also in a diagonal direction (or a turning direction) in each direction.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is illustrated by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
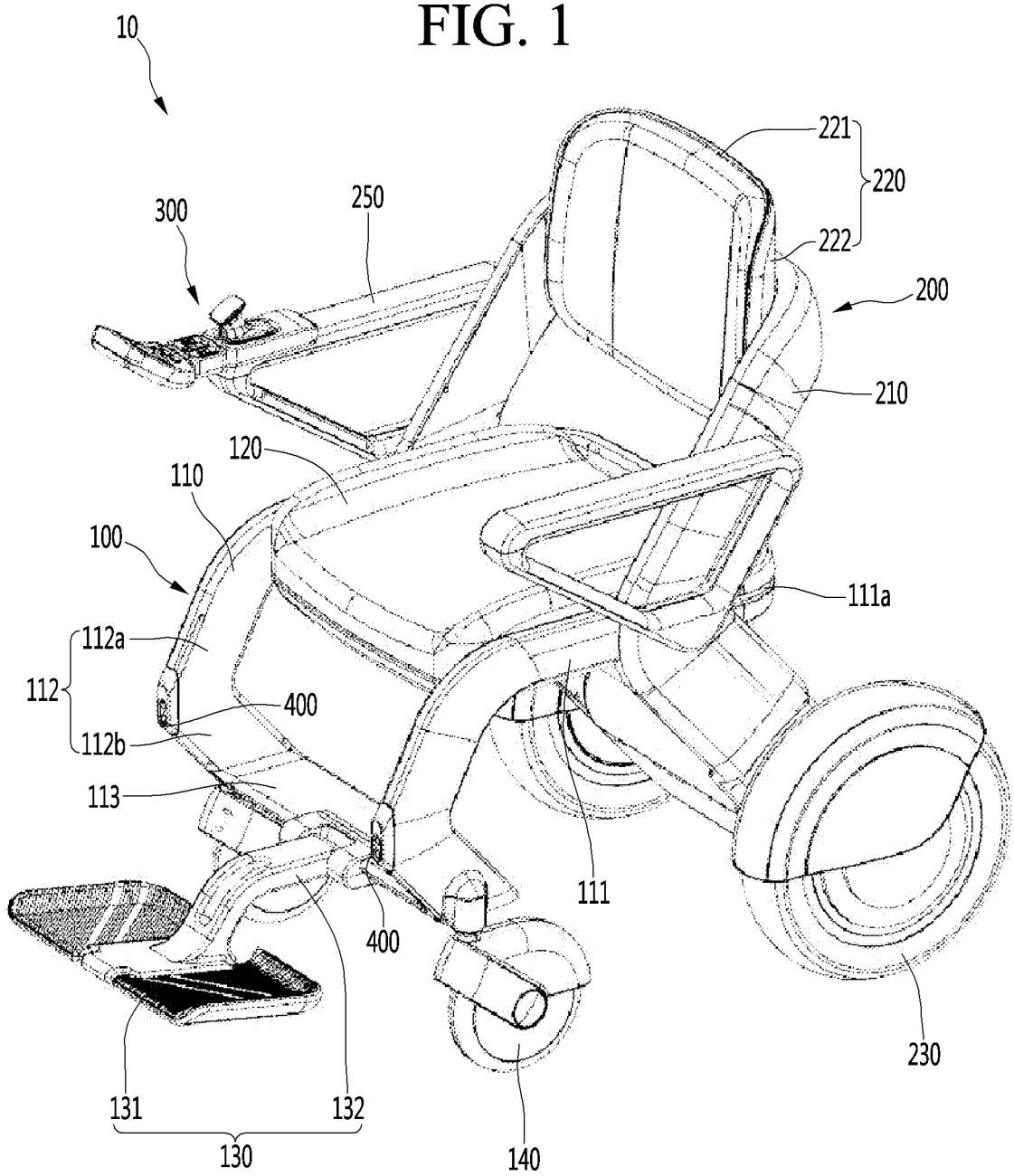
FIG. 1 is a front perspective view illustrating an electric wheelchair according to an embodiment of the present disclosure.
Figure 2:
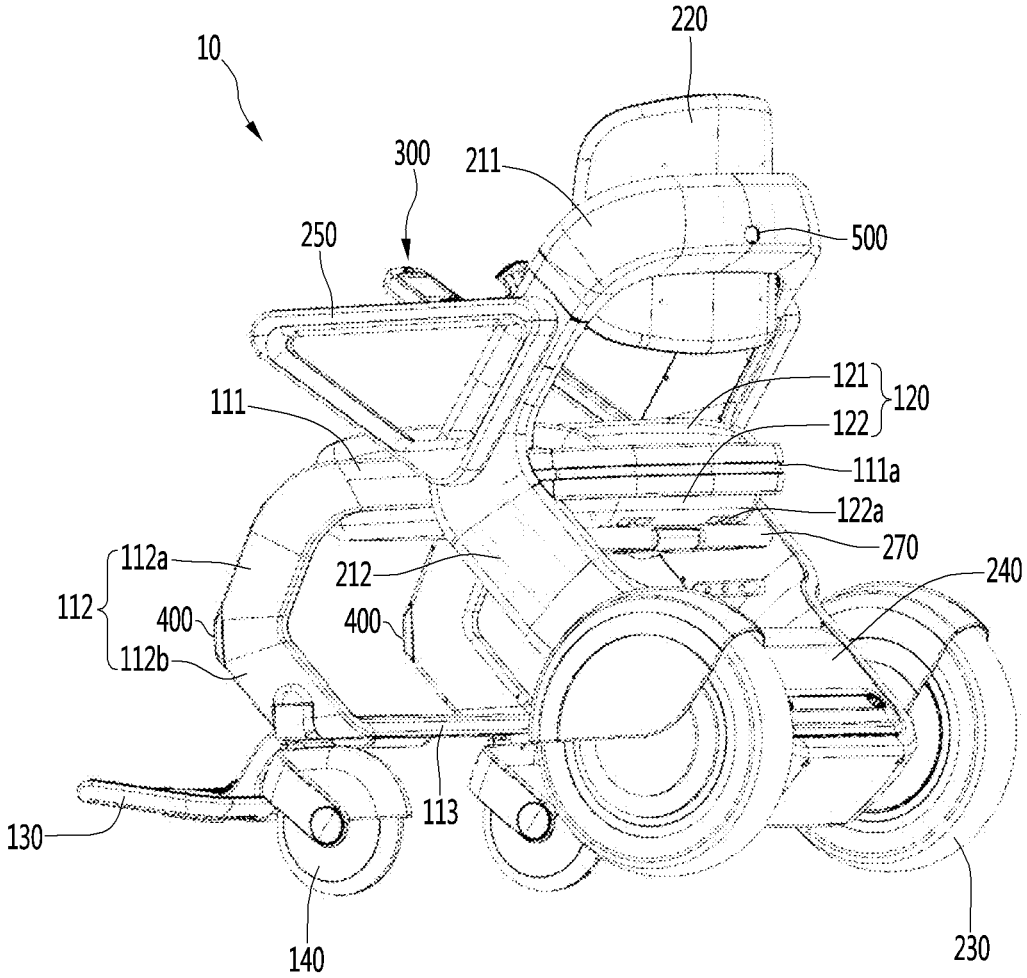
FIG. 2 is a rear perspective view illustrating the electric wheelchair according to the embodiment of the present disclosure.
Figure 3:
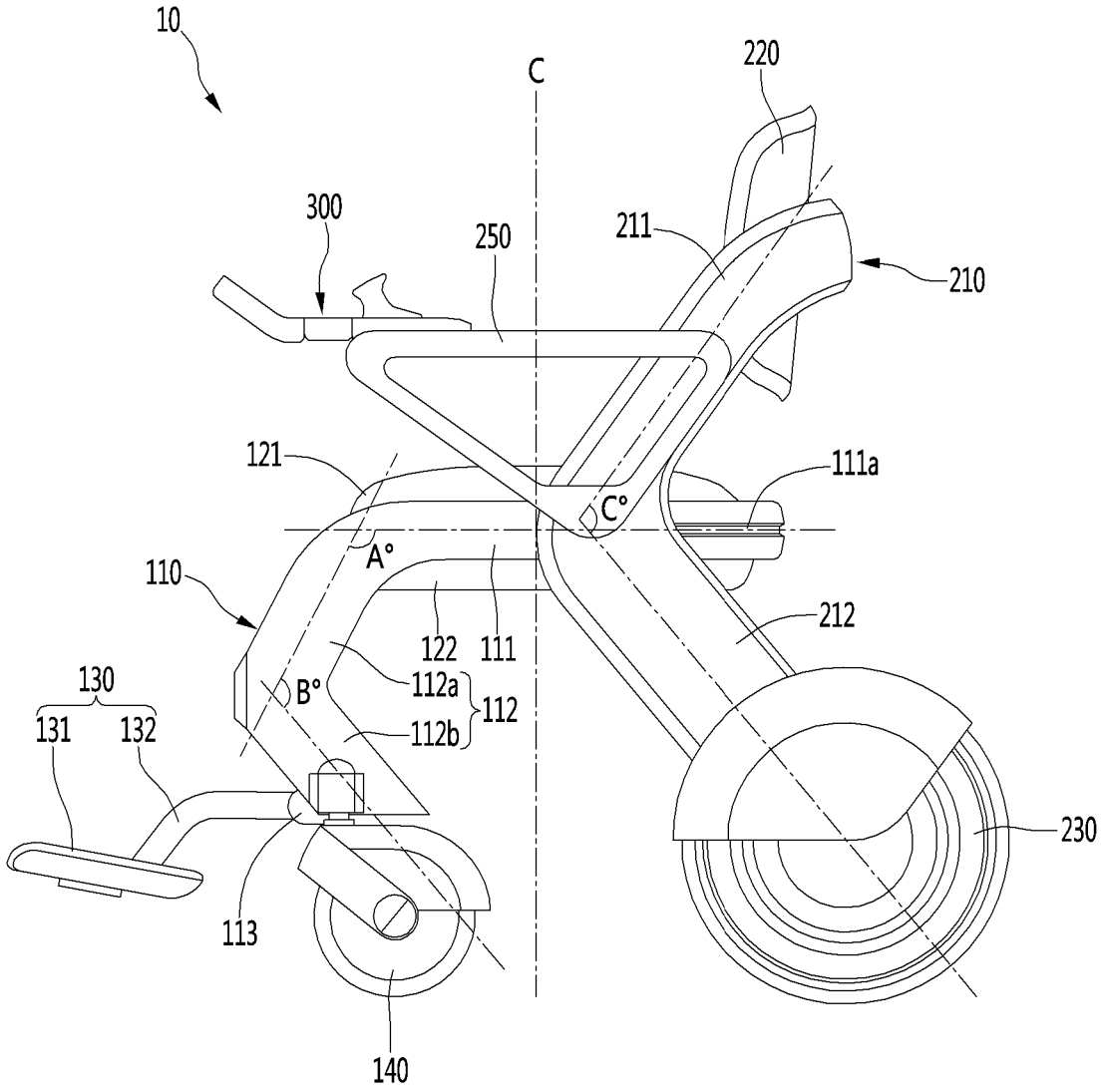
FIG. 3 is a side view illustrating the electric wheelchair according to an embodiment of the present disclosure.
Figure 4:
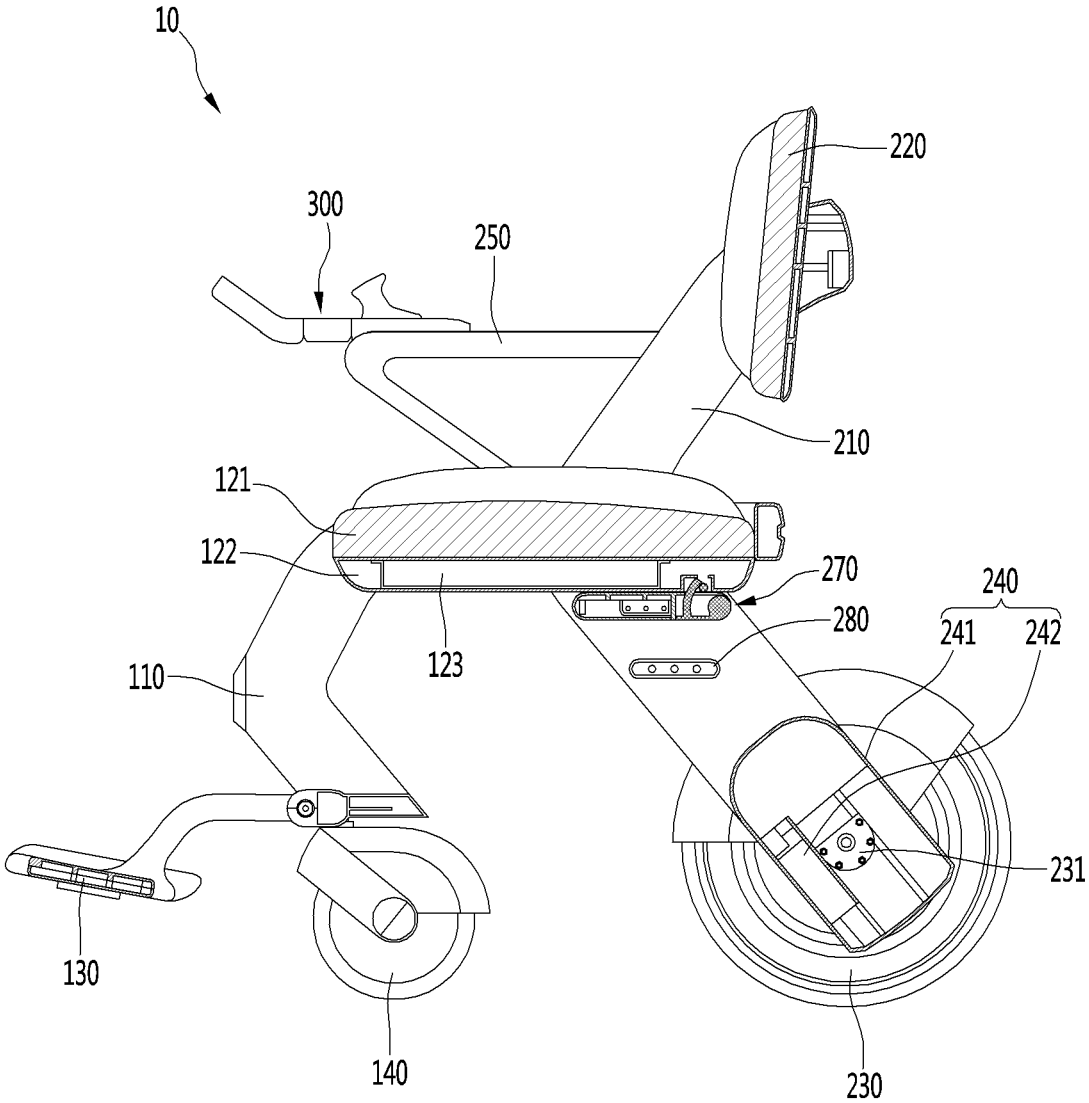
FIG. 4 is a longitudinal sectional view illustrating the electric wheelchair according to an embodiment of the present disclosure.

FIG. 1 is a front perspective view illustrating an electric wheelchair according to an embodiment of the present disclosure, FIG. 2 is a rear perspective view illustrating the electric wheelchair according to the embodiment of the present disclosure, FIG. 3 is a side view illustrating the electric wheelchair according to an embodiment of the present disclosure, and FIG. 4 is a longitudinal sectional view illustrating the electric wheelchair according to an embodiment of the present disclosure.

Referring to FIGS. 1 to 4, the electric wheelchair 10 may include a robot.

The electric wheelchair 10 according to the present disclosure includes a first module 100 and a second module 200 coupled to the first module 100.

At least one of the first module 100 and the second module 200 may be referred to as a "robot".

The first module 100 may be disposed at the front of the electric wheelchair 10, and the second module 200 may be disposed at the rear of the electric wheelchair 10. In addition, the first module 100 and the second module 200 may be detachably coupled to each other.

Here, the "front" means a direction that the electric wheelchair 10 faces while driving, and the "rear" may be understood as the opposite direction of the front.

The first module 100 is defined as a front module because the first module is disposed in front of the electric wheelchair 10, the second module 200 may be defined as a rear module because the second module is disposed in the rear of the electric wheelchair 10.

The first module 100 is a portion provided with a seating unit 120 to allow a person to actually sit. In addition, the first module 100 includes a battery 123. The battery 123 may be provided inside the seating unit 120.

The second module 200 is a portion provided with a plurality of parts for driving of the electric wheelchair 10. The second module 200 includes a main wheel 230 provided with a motor 231 for driving.

In general, an electric wheelchair can be understood as one of the parts with the heaviest battery and motor. Correspondingly, in the present disclosure, when the first module 100 and the second module 200 are separated from each other, the weight of each module can be distributed to the same or similar level by disposing the battery 123 in the first module 100 and disposing the motor 231 in the second module 200. Therefore, there is an advantage that the transfer and loading thereof is easy when the electric wheelchair 10 is separated.

In detail, the first module 100 may include a front frame 110, a seating unit 120 coupled to one side of the front frame 110, and a leg rest unit 130 coupled to the other side.

The front frame 110 is disposed in front of the electric wheelchair 10, and, when the person is seated on the electric wheelchair 10, can support the weight thereof. The front frame 110 may be formed as a closed curve in which the inside is empty.

The seating unit 120 may be disposed above the front frame 110, and the leg rest unit 130 may be disposed below the front frame 110.

According to an embodiment, the front frame 110 may include a first frame 111 supporting the seating unit 120, second frames 112 bent downward from both sides of the first frame 111, respectively, and a third frame 113 connecting each end portion of the second frame 112.

The first frame 111, the second frame 112, and the third frame 113 may be integrally formed.

The first frame 111 may be formed to surround a circumference of the seating unit 120. In other words, the first frame 111 may be formed in a hollow shape so that the seating unit 120 may be inserted into the inside thereof.

At this time, a portion of the inner side surface of the first frame 111 is fixed to both side surfaces of the seating unit 120, so that even if a load is applied to the seating unit 120, the seating unit 120 may be prevented from being deviated from the first frame 111.

For example, the first frame 111 may be formed in a "ㄷ" shape. The seating unit 120 may be inserted into and fixed to the inside of the first frame 111. Therefore, the first frame 111 may be seen to cover both side surfaces and the rear surface of the seating unit 120.

In addition, the first frame 111 includes a slide groove 111*a*.

The slide groove 111*a* is a portion for being coupled by sliding the first module 100 to the second module 200. The slide groove 111*a* may be fitted into a slide protrusion (not illustrated) provided in the second module 200 so as to be coupled to the inside of the second module 200.

The slide groove 111*a* may be recessed inward from an outer surface of the first frame 111. For example, the slide grooves 111*a* may be formed on both side surfaces of the first frame 111, respectively. The slide groove 111*a* may be elongated in a front and rear direction on both side surfaces of the first frame 111.

In addition, the slide groove 111*a* may be formed not only on both side surfaces of the first frame 111 but also on the rear surface of the first frame 111. At this time, the slide grooves 111*a* may be connected to each other to form one slide groove 111*a*.

By this configuration, the first module 100 is capable of sliding movement and coupling inside the second module 200 in the front and rear direction.

The second frame 112 is a portion that is bent downward from both sides of the first frame 111, respectively. The second frame 112 may be formed to be rounded downward from the front end portion of the first frame 111.

At this time, the second frame 112 may have a front extension portion 112*a* extending forward from the first frame 111 and a rear extension portion 112*b* extending rearward from an end portion of the front extension portion 112*a*.

In other words, the front extension portion 112*a* and the rear extension portion 112*b* may extend in different directions from each other, respectively. Since the front extension portion 112*a* and the rear extension portion 112*b* are formed to be rounded in different directions, the entire volume of the front frame 110 may be reduced.

On the other hand, as illustrated in FIG. 3, the angle A formed between the first frame 111 and the first extension portion 112*a* may be, for example, 120 degrees. In addition, the angle B formed by the first extension portion 112*a* and the second extension portion 112*b* may be designed so as to be larger than 90 degrees and smaller than 120 degrees.

In other words, since an angle A formed by the first frame 111 and the first extension portion 112*a* and an angle formed by the first extension portion 112*a* and the second extension portion 112*b* form an obtuse angle, the volume of the front frame 110 can be minimized.

The third frame 113 connects respective end portions of the second frame 112. The third frame 113 is formed long in the horizontal direction and may support the leg rest unit 130 to be described later.

The seating unit 120 is coupled to the inside of the front frame 110 and is configured to allow a person to sit.

The seating unit 120 includes a seat 121 and a seat cover 122 coupled to the lower side of the seat 121.

The sheet 121 may be formed of soft and elastic material as a portion which is in contact with buttocks when a person seats.

The seat cover 122 is coupled to the lower side of the sheet 121 as a portion supporting the sheet 121. The seat cover 122 may be coupled to the inside of the front frame 110. For example, the seat cover 122 may be fastened to the inner surface of the first frame 111 by a fastening member.

In addition, a battery 123 is disposed in the seating unit 120. The battery 123 may provide power to the control box 240 and the motor 231 to be described later.

In detail, the battery 123 may be disposed in the seat cover 122. To this end, the seat cover 122 may form a receiving space to receive the battery 123 therein.

The battery 123 may provide power to a side of the second module 200 when the seat cover 122 is coupled to the second module 200. To this end, a connection groove 122*a* for inserting a connection terminal (not illustrated) provided in the second module 200 may be formed in the seat cover 122.

The connection groove 122*a* may be formed on the bottom surface of the seat cover 122. When the connection terminal is inserted into the connection groove 122*a*, the power of the battery 123 may be transmitted to the motor 231 of the second module 200 through the connection terminal.

The leg rest unit 130 supports the leg or the foot of the person and is rotatably coupled to the front frame 110.

The leg rest unit 130 includes a footrest unit 131 for supporting a foot of a person and a connection portion 132 for connecting the footrest unit 131 to the front frame 110.

The footrest unit 131 is formed to have a predetermined area so that both feet of a person can be seated. In addition, one end of the connection portion 132 is coupled to the footrest unit 131, and the other end thereof is hinged to the front frame 110. Therefore, the leg rest unit 130 may be rotated by the connection portion 132 to be folded into the front frame 110.

In addition, the first module 100 further includes an auxiliary wheel 140.

The auxiliary wheel 140 is coupled to one side of the front frame 110 to assist the movement or driving of the electric wheelchair 10. In detail, a plurality of auxiliary wheels 140 may be provided and may be provided at lower ends of both sides of the second frame 122, respectively. The auxiliary wheel 140 may include a caster.

On the other hand, the second module 200 may include a rear frame 210, a backrest unit 220 which is coupled to one side of the rear frame 210, and a main wheel 230 which is coupled to the other side of the rear frame 210.

The rear frame 210 is disposed at the rear of the electric wheelchair 10 and supports parts for driving the electric wheelchair 10. The rear frame 210 may be formed as a closed curve in which the inside thereof is empty.

The backrest unit 220 may be disposed above the rear frame 210, and the main wheel 230 may be disposed below the rear frame 210.

According to an embodiment, the rear frame 210 may include an upper frame 211 supporting the backrest unit 220 and a lower frame 212 which is connected to the lower portion of the upper frame 211 and supports the main wheel 230.

The upper frame 211 and the lower frame 212 may be integrally formed. The upper frame 211 and the lower frame 212 may be connected to each other to form a single closed curve.

The upper frame 211 may be formed to be inclined backward, for example, be being formed in a "ㄱ" shape. The upper frame 211 may extend toward the front as being lowered downward.

In addition, the backrest unit 220 may be installed on an upper portion of the upper frame 211. The backrest unit 220 may be installed on an upper inner surface of the upper frame 211.

The lower frame 212 further extends downward from both lower sides of the upper frame 211. In detail, the lower frame 212 may extend toward both the rear and the lower side of the electric wheelchair 10 from both lower end portions of the upper frame 211.

Meanwhile, based on FIG. 3, the angle C formed by the upper frame 211 and the lower frame 212 may be designed to be larger than 90 degrees and smaller than 120. In other words, the angle C formed by the upper frame 211 and the lower frame 212 may be designed at an obtuse angle.

In addition, a slide protrusion (not illustrated) may be formed on the rear frame 210.

The slide protrusion is configured to be inserted into the slide groove 111*a* of the front frame 110 so that the front frame 110 can be coupled to the rear frame 210.

The slide protrusions may be formed to protrude from both inner surfaces of the rear frame 210, respectively. The slide protrusion may be formed in a straight line in the front and rear direction.

The slide protrusion may be provided at a portion where the upper frame 211 and the lower frame 212 are connected. Alternatively, the slide protrusion may be provided at a boundary area between the upper frame 211 and the lower frame 212.

Therefore, since the first frame 111 may be coupled to a portion corresponding to the middle height of the rear frame 210, the front frame 110 and the rear frame 210 may be stably coupled. The height of the seating unit 120 can be easily adjusted.

The backrest unit 220 includes a seat 221 and a seat cover 222 coupled to a rear surface of the seat 221.

The sheet 221 may be formed of soft and elastic material as a portion which is in contact with back part when a person is seated on the seating unit 120.

The seat cover 222 is coupled to the rear surface of the seat 221 as a portion supporting the seat 221. The seat cover 222 may be coupled to the inside of the rear frame 210.

In detail, the seat cover 222 may be coupled to an upper-end portion of the upper frame 211. For example, the seat cover 222 may be fastened by a fastening member to an inside surface of the upper frame 211.

The main wheel 230 is configured to allow the electric wheelchair 10 to drive substantially. The main wheel 230 is provided on both lower sides of the rear frame 210 and supports the load of the electric wheelchair 10. The main wheel 230 has a larger diameter than the auxiliary wheel 140.

Specifically, a pair of main wheels 230 are provided and may be installed on both lower sides of the lower frame 212, respectively. The main wheel 230 may include a motor 231, a rotation shaft, an inwheel, and a tire.

The motor 231 includes a stator, a rotor, a magnet, and the like, and generates a driving force to rotate the inwheel.

The rotation shaft is coupled to the inside of the rotor and may transfer the driving force generated by the motor 231 to the inwheel side.

The inwheel may be coupled to the rotation shaft to be rotated by receiving a driving force generated from the motor 231.

The tire is coupled to the outside of the inwheel and may elastically support the electric wheelchair 10 from the ground.

The main wheel 230 may be referred to as a "driver" or "drive unit". The driver may be robot.

In addition, the second module 200 may further include a control box 240 for controlling the motor 231.

The control box 240 may be installed below the rear frame 210.

In detail, the control box 240 is disposed at the lower end portion of the lower frame 212. The control box 240 has a substantially square shape and is provided inside the lower frame 212.

At this time, as illustrated in FIG. 3, the control box 240 may be disposed so that the side surface thereof is covered by the lower frame 212. In other words, the control box 240 is disposed to be inclined in correspondence to the inclination angle of the lower frame 212. Therefore, when the electric wheelchair 10 is viewed from the side, since the outer appearance of the control box 240 has a hidden structure, the electric wheelchair 10 has an advantage that the outer appearance is neat when driving.

The control box 240 may include a box case 241 forming an outer appearance and a plurality of electronic components 242 provided inside the box case 241.

In addition, the second module 200 may further include an armrest unit 250.

The armrest unit 250 is a portion that supports an arm or a hand when a person is seated.

The armrest unit 250 has a triangular shape, the armrest unit may be coupled to both sides of the rear frame 210, respectively. The armrest unit 250 may be provided to be rotatable on both sides of the rear frame 210, respectively.

In addition, the second module 200 may further include a connection plate 270.

The connection plate 270 may be understood as a configuration for electrically connecting the first module 100 and the second module 200.

When the connection plate 270 and the first module 100 are connected, the power of the battery 123 of the first module 100 may be supplied to the motor 231 of the second module 200 and the electronic component 242.

In addition, the second module 200 may further include a basket mounting portion 280.

The basket mounting portion 280 is a portion for mounting a basket that can hold belongings and the like. The basket mounting portion 280 may be provided inside the rear frame 210.

Specifically, the basket mounting portion 280 may be formed to protrude on both inner sides of the lower frame 212, respectively. The basket mounting portion 280 may be elongated on the inner surface of the lower frame 212 in the front and rear direction.

The basket may be mounted by fastening the fastening member to the basket mounting portion 280. Alternatively, a portion of the basket may be mounted by being engaged with the basket mounting portion 280.

On the other hand, the electric wheelchair 10 may further include a controller 300.

The controller 300 is understood as a configuration that allows a user to operate the driving of the electric wheelchair 10. The controller 300 may include a display unit, a button unit, a joystick unit, and the like.

The controller 300 may be installed in the second module 200. For example, the controller 300 may be installed in the armrest unit 250 of the second module 200.

In addition, the electric wheelchair 10 may further include a front camera 400.

The front camera 400 is understood as a configuration for imaging an area corresponding to the front of the electric wheelchair 10 when the electric wheelchair 10 is driving. For example, when the electric wheelchair 10 is driving forward, the front camera 400 may be driven to image the front area of the electric wheelchair 10.

In addition, the captured image may be provided to the controller 300 and output through the display unit of the controller 300.

In this embodiment, the front camera 400 may be installed in the first module 100. For example, the front camera 400 may be installed in the front frame 110 of the first module 100. A plurality of front cameras 400 may be installed in front of the second frame 112 of the front frame 110. However, the present disclosure is not limited thereto, and the front camera 400 may be installed at any point capable of imaging the front area of the electric wheelchair 10.

In addition, the electric wheelchair 10 may further include a rear camera 500.

The rear camera 500 is understood as a configuration for imaging an area corresponding to the rear of the electric wheelchair 10 when the electric wheelchair 10 is driving. For example, when the electric wheelchair 10 is driving backward, the rear camera 500 may be driven to image the rear area of the electric wheelchair 10.

The captured image may be provided to the controller 300 and output through the display unit of the controller 300.

In the present embodiment, the rear camera 500 may be installed in the second module 200. For example, the rear camera 500 may be installed in the rear frame 210 of the second module 200. The rear camera 500 may be installed at the rear of the upper frame 211 of the rear frame 210.

In other words, the rear camera 500 may be disposed at a portion of the upper frame 211 in which the backrest unit 220 is installed. However, the present disclosure is not limited thereto, and the rear camera 500 may be installed at any point capable of imaging the rear area of the electric wheelchair 10.

Figure 5:
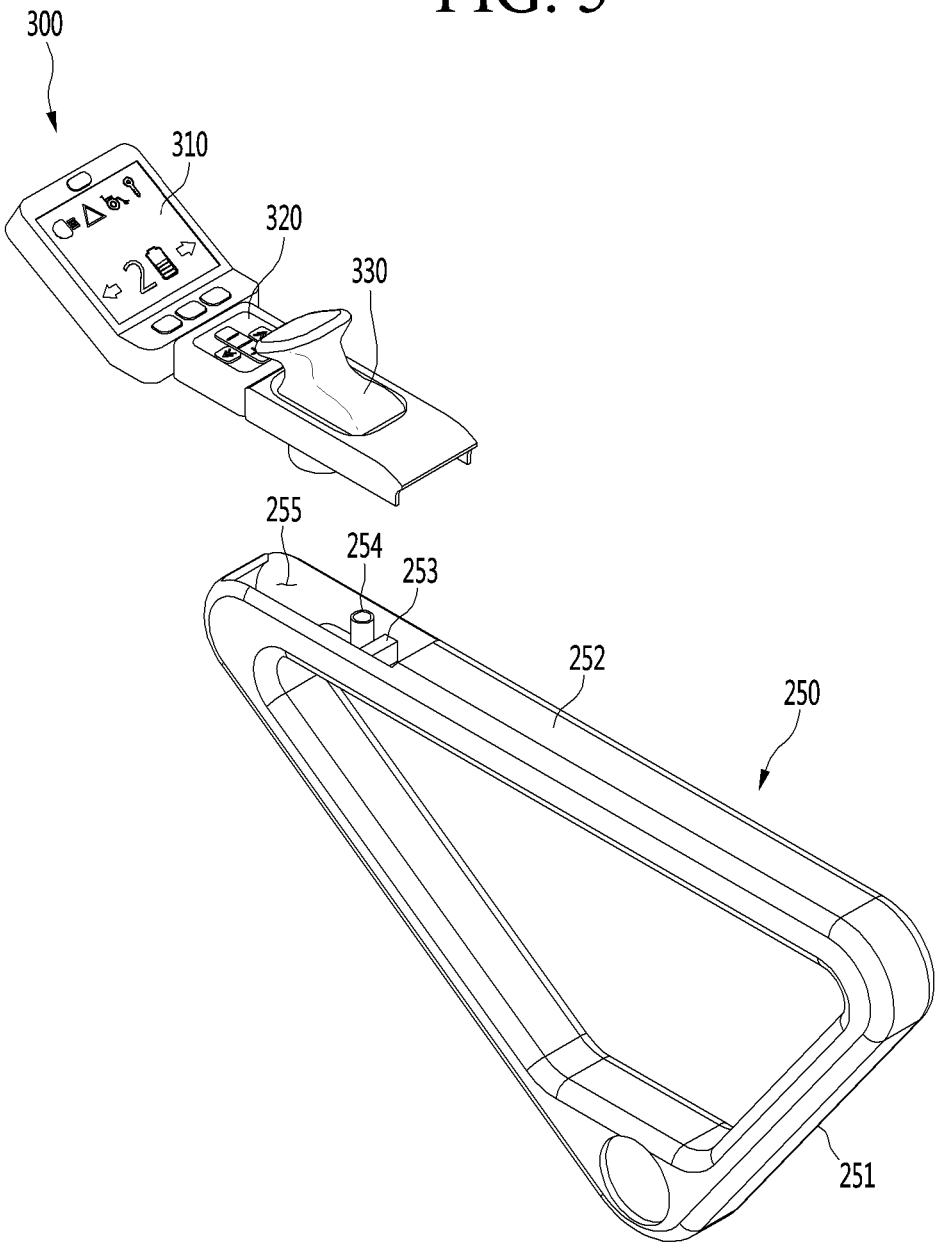
FIG. 5 is a view illustrating a state where the controller according to an embodiment of the present disclosure is separated from the armrest unit.
Figure 6:
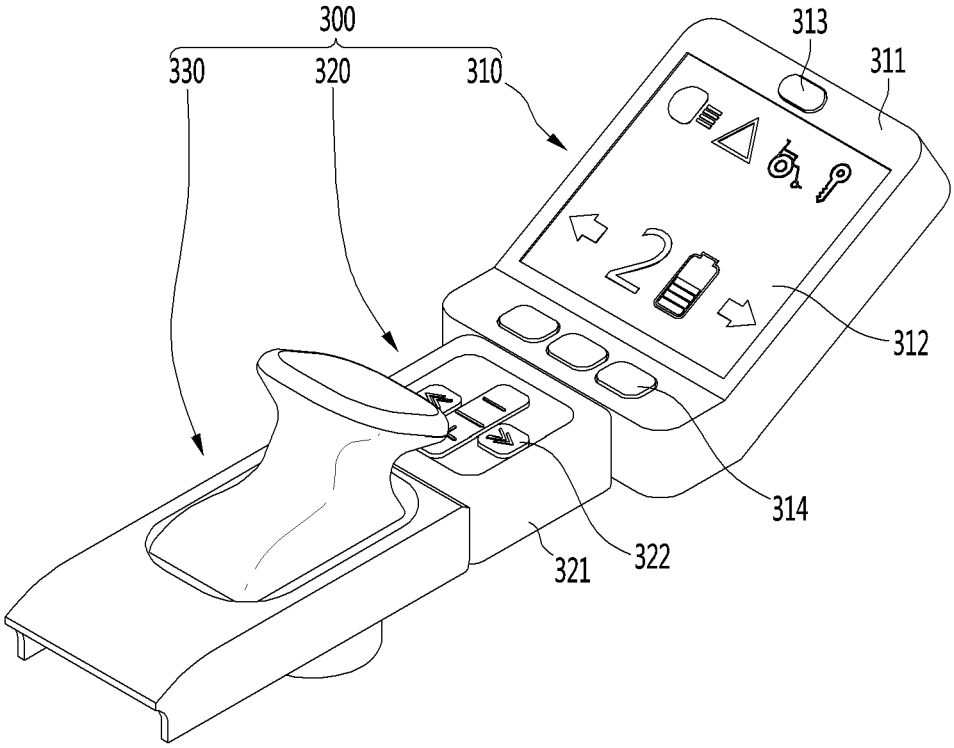
FIG. 6 is a perspective view illustrating a joystick unit according to an embodiment of the present disclosure.

FIG. 5 is a view illustrating a state where the controller according to an embodiment of the present disclosure is separated from the armrest unit, and FIG. 6 is a perspective view illustrating a joystick unit according to an embodiment of the present disclosure.

Referring to FIGS. 5 and 6, the controller 300 according to the embodiment of the present disclosure may be provided in the armrest unit 250. The controller 300 may be detachably coupled to the upper portion of the armrest unit 250.

Here, the controller 300 may be selectively installed on any one of the pair of armrest units 250 provided on both sides of the rear frame 210.

In this embodiment, the controller 300 will be described as being provided to the armrest unit 250 corresponding to the right side of the rear frame 210.

The controller 300 is coupled to shield the opening portion 255 formed in the armrest unit 250 and is electrically connected to the connector 253 located inside the armrest unit 250.

Specifically, the armrest unit 250 has a triangular shape, the armrest units may be coupled to both sides of the rear frame 210, respectively. The armrest unit 250 may be provided to be rotatable on both sides of the rear frame 210, respectively.

According to an embodiment, the armrest unit 250 may include a frame body 251 and a frame cover 252 coupled to an upper portion of the frame body 251.

The frame body 251 may be formed in a hollow shape and formed in an inverted triangle shape. The inside of the frame body 251 may be provided with a connector 253 to which an electric wire connected to the controller 300 is connected.

The connector 253 may be disposed above the frame body 251.

In detail, the connector 253 may be disposed on an upper surface corresponding to an upper portion of the frame body 251. In addition, when the controller 300 is installed in the armrest unit 250, an electric wire (not illustrated) connected to the controller 300 is connected to the connector 253, the controller 300 and the circuit board of the control box 240 may be electrically connected to each other. At this time, the controller 300 may be electrically connected to the control box 240 and electrically connected to the battery 123.

In addition, a fastening boss 254 to which a portion of the controller 300 is fastened may be provided inside the frame body 251.

The fastening boss 254 may be disposed above the frame body 251. A plurality of fastening bosses 254 may be provided at points adjacent to the connector 253.

The fastening boss 254 is fastened to a portion of the controller 300 when the controller 300 is installed in the armrest unit 250 so that the controller 300 can be stably fixed.

The frame cover 252 is coupled to the frame body 251.

The frame cover 252 may be coupled to an upper portion of the frame body 251 to form an inner space in which the connector 253 is received.

In addition, the frame cover 252 includes an opening portion 255 for exposing the inner space of the armrest unit 250 to the outside.

The opening portion 255 may be formed by cutting any point of the upper surface of the frame cover 252. The connector 253 and the fastening boss 254 disposed in the frame body 251 may be exposed to the outside by the opening portion 255. At this time, the opening portion 255 may be disposed above the connector 253 or the fastening boss 254.

In addition, the controller 300 may be installed in the frame cover 252 while the connector 253 and the fastening boss 254 are exposed to the outside.

The controller 300 may be installed to shield the opening portion 255 of the frame cover 252. In other words, the controller 300 may be disposed to cover all of the opening portion 255 of the frame cover 252. At this time, a portion of the controller 300 may be received in the inner space of the armrest unit 250 through the opening portion 255 of the frame cover 252.

In this configuration, since the controller 300 is coupled to shield the opening portion 255 formed in the armrest unit 250, and is electrically connected to the connector 253 located inside the armrest unit 250, the electric wire connected to the controller 300 is not exposed to the outside. Accordingly, there are advantages that the outer appearance of the product is beautiful and the electric short circuit due to leakage in rainy weather is prevented in advance.

On the other hand, although not illustrated in the figure, an electric wire (not illustrated) for connecting the connector 253 and the control box 240 is provided inside the armrest unit 250.

Specifically, the electric wire extending from the connector 253 extends below the armrest unit 250 through the hollow of the armrest unit 250. The electric wire extending downward extends into the rear frame 210 through a portion (hinge) in which the armrest unit 250 is coupled to the rear frame 210. The electric wire extending into the rear frame 210 extends toward the control box 240 through the hollow of the lower frame 212. In other words, when the controller 300 is installed in the armrest unit 250, all of the electric wires connected to the controller 300 are located inside the armrest unit 250.

In addition, in the present embodiment, the armrest unit 250 is described in an inverted triangle shape but is not limited thereto. For example, the armrest unit 250 may be formed in a circular or square shape. At this time, an electric wire having a circular or square shape may be provided inside the armrest unit 250 corresponding to the shape.

Meanwhile, the controller 300 may include a display unit 310, a button unit 320, and a joystick unit 330. At this time, the controller 300 may be integrally fixed to the display unit 310, the button unit 320, and the joystick unit 330 to be provided to the armrest unit 250.

Therefore, since the controller 300 may be installed as one module in any one armrest unit 250 of the pair of armrest units 250, there are advantages that the installation of the controller is easy and both right-handed and left-handed can be used.

In detail, the controller 300 may include a joystick unit 330 coupled to the armrest unit 250, a button unit 320 coupled to the front of the joystick unit 330, and a display unit 310 coupled to a front of the button unit 320.

The display unit 310 includes a display housing 311 and a display 312 disposed on an upper surface of the display housing 311.

The display housing 311 is formed so that at least a portion thereof is inclined or erected. Accordingly, the user sitting on the electric wheelchair 10 can easily look down the display 312 provided on the inclined display housing 311 surface.

The display 312 may provide information related to driving when the electric wheelchair 10 is driven. For example, the display 312 may display current speed, a battery remaining amount, a dangerous situation warning when the electric wheelchair 10 is driving, or the like.

In addition, the image captured by the front camera 400 or the image captured by the rear camera 500 may be displayed on the display 312.

An image captured by the front camera 400 or an image captured by the rear camera 500 may be selectively displayed on the display 312 according to a user command.

For example, the rear camera 500 may be operated while the electric wheelchair 10 is driven so that a rear image may be displayed on the display 312. Alternatively, when the electric wheelchair 10 moves backward, the rear camera 500 may operate to display a rear image on the display 312.

The display unit 310 may further include a speaker 313.

The speaker 313 may be disposed on an upper surface of the display housing 311. For example, the speaker 313 may be disposed adjacent to an upper side of the display 312. The speaker 313 may output driving information, a warning sound, or the like related to the driving of the electric wheelchair 10 as a voice.

In addition, the display unit 310 may further include a key input unit 314.

The key input unit 314 may be disposed on an upper surface of the display housing 311. For example, the key input unit 314 may be disposed adjacent to the lower side of the display 312. The user may select an icon or information displayed on the display 312 through the key input unit 314.

The button unit 320 may include a plurality of key buttons for inputting a command for driving the electric wheelchair 10. The button unit 320 may be disposed behind the display unit 310. The button unit 320 may be fixed to one side of the display unit 310.

The button unit 320 may include a button housing 321 and a plurality of key buttons 322 disposed on an upper surface of the button housing 321.

The button housing 321 may be formed in a substantially square shape. The button housing 321 is coupled to one side of the display 310. The button housing 321 may be disposed between the display unit 310 and the joystick unit 330 to be described later. In other words, the button housing 321 may connect the display unit 310 and the joystick unit 330 to each other.

The plurality of key buttons 322 may include a button for increasing or decreasing a speed of the electric wheelchair 10, a button for increasing or decreasing a volume output from the electric wheelchair 10, and the like.

The joystick unit 330 serves to control the speed and direction of the electric wheelchair 10 when driving. The joystick unit 330 may be coupled to one side of the button unit 320. The joystick unit 330 may be disposed behind the button unit 320.

Meanwhile, the display unit 310, the button unit 320, and the joystick unit 330 may be connected to each internal space. In other words, space through which an electric wire passes may be provided in the display 310, the button unit 320, and the joystick unit 330.

Hereinafter, the joystick unit 330 will be described in more detail with reference to the accompanying drawings.

Figure 7:
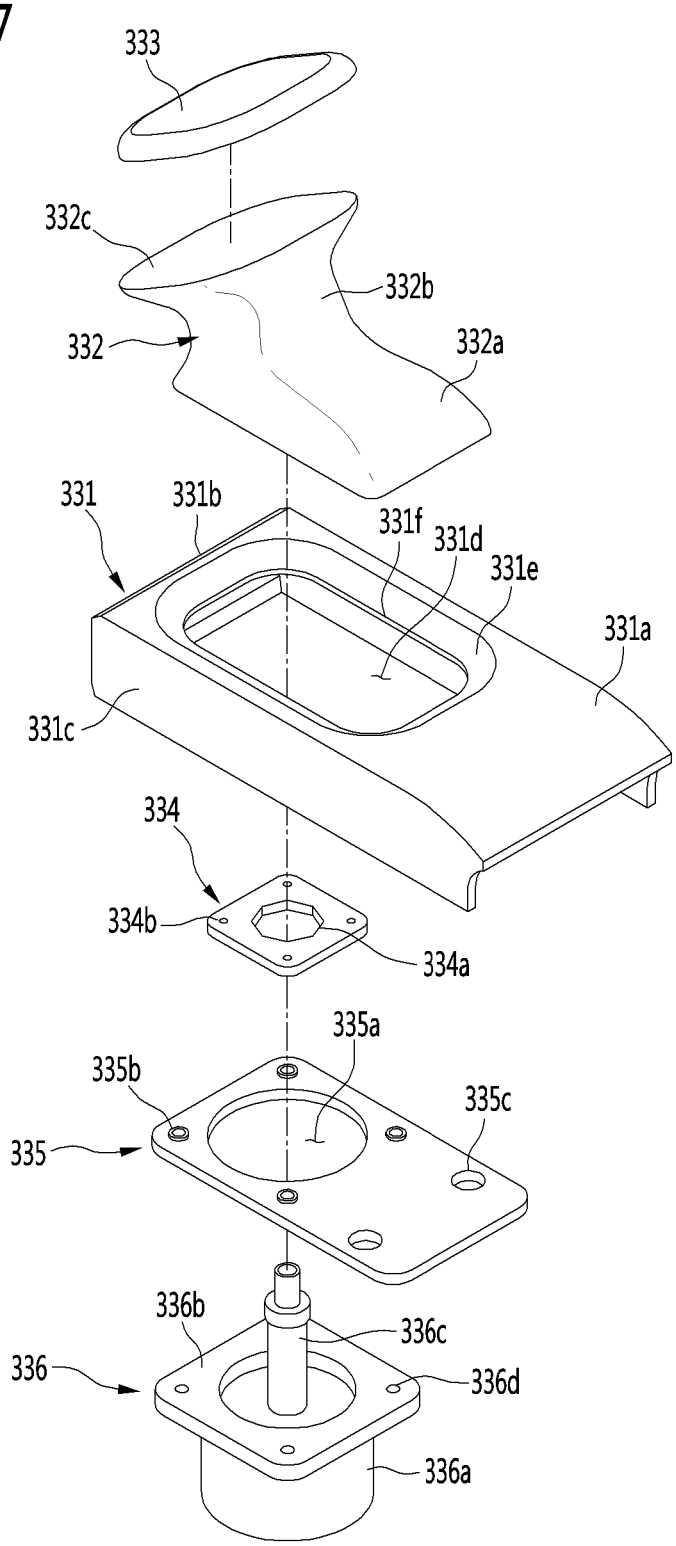
FIG. 7 is an exploded perspective view illustrating a joystick unit according to an embodiment of the present disclosure.
Figure 8:
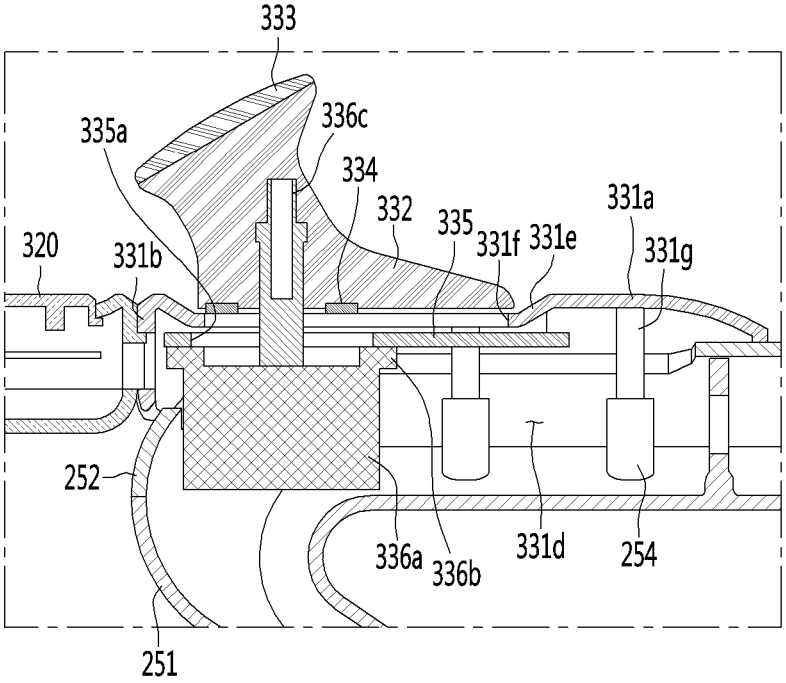
FIG. 8 is a longitudinal sectional view illustrating a joystick unit according to an embodiment of the present disclosure.

FIG. 7 is an exploded perspective view illustrating a joystick unit according to an embodiment of the present disclosure. FIG. 8 is a longitudinal sectional view illustrating a joystick unit according to an embodiment of the present disclosure, and FIG. 9 is a plan view illustrating a lever guide according to an embodiment of the present disclosure.

Figure 9:
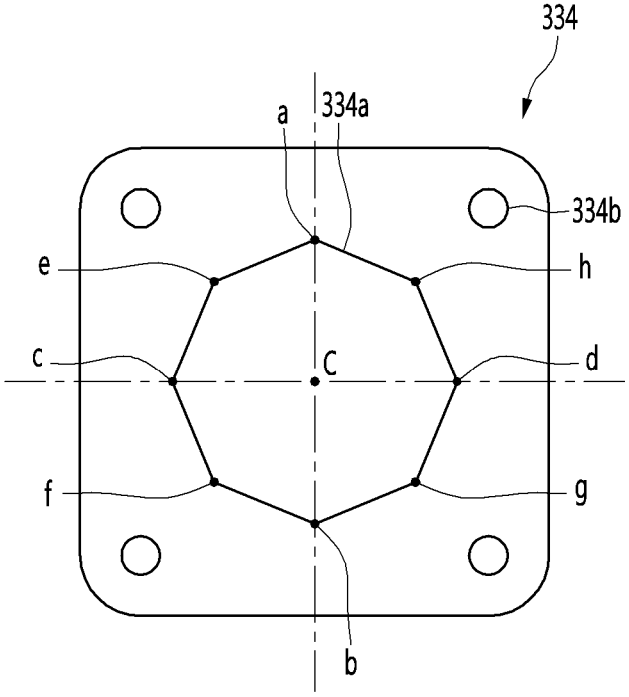
FIG. 9 is a plan view illustrating a lever guide according to an embodiment of the present disclosure.

Referring to FIGS. 7 to 9, the joystick unit 330 according to the present disclosure includes a joystick housing 331 and a joystick lever 332 disposed outside the joystick housing 331.

The joystick housing 331 may have a box shape with an open lower portion. The joystick housing 331 may be coupled to shield the opening portion 255 formed in the armrest unit 250. The joystick lever 332 may be disposed above the joystick housing 331.

According to one embodiment, the joystick housing 331 is a top surface 331*a*, a front surface 331*b* extending downward from the front end portion of the top surface 331*a*, and a pair of side surfaces 331*c* downwardly extending from both sides of the top surface 331*a*.

The pair of side surfaces 331*c* and the front surface 331*b* may be connected to each other. The lower and rear surfaces of the joystick housing 331 may be opened.

A predetermined inner space 331*d* may be formed inside the joystick housing 331 by the upper surface 331*a*, the front surface 331*b*, and the side surface 331*c*.

When the joystick housing 331 is coupled to the armrest unit 250, the opening portion 255 of the armrest unit 250 may be shielded by the upper surface 331*a* of the joystick housing 331. In addition, the pair of side surfaces 331*c* may surround portions of both side surfaces of the frame cover 252.

On the upper surface 331*a*, a recessed portion 331*e* in which the joystick lever 332 is disposed may be formed. The recessed portion 331*e* may be formed by recessing a portion of the upper surface 331*a* to a predetermined depth downward.

At this time, the recessed portion 331*e* may include an opening portion 331*f* through which at least a portion thereof is opened. When the joystick housing 331 is coupled to the opening portion 255 of the armrest unit 250, the internal space 331*d* may be exposed to the outside through the opening portion 331*f* of the joystick housing 331.

Here, the opening portion 255 formed in the armrest unit 250 may be defined as a "first opening portion", and the opening portion 331*f* formed in the joystick housing 331 may be defined as a "second opening portion".

In addition, the joystick housing 331 may further include a protrusion portion 331*g*.

The protrusion portion 331*g* may be formed to protrude inward from the inner surface of the joystick housing 331. The protrusion portion 331*g* may be understood as a part that is fastened to the fastening boss 254 formed on the frame body 251 when the joystick housing 331 is installed on the armrest unit 250.

For example, the protrusion portion 331*g* may extend downward from the top surface 331*a* of the joystick housing 331. In addition, the plurality of protrusion portions 331*g* may be formed to be spaced apart from each other on the upper surface 331*a* of the joystick housing 331.

The joystick lever 332 is actually a portion for operating the electric wheelchair 10 by a user. The joystick lever 332 may be a device using the principle that the variable resistance value of the corresponding direction (X-axis, Y-axis) changes when the user moves the lever, and thus the voltage value input to the analog pin is changed.

At this time, the joystick lever 332 can be operated not only in four directions, but also in four directions, that is, front, rear, left, and right directions and in a diagonal direction (or a turning direction) of each direction. In other words, the user can operate or move in a total of eight directions using the joystick lever 332.

According to one embodiment, the joystick lever 332 is a lever body 332*a* disposed in the recessed portion 331*e*, a lever handle 332*b* extending upward from the lever body 332*a*, and a flat portion 332*c* provided at the upper-end portion of the lever handle 332*c*.

The lever body 332*a* may have an area corresponding to the recessed portion 331*e* or the opening portion 331*f*. The bottom portion of the lever body 332*a* may be formed flat.

The lever handle 332*b* is formed by extending a part of the lever body 332*a* upward. At this time, the lever handle 332*b* may extend inclined forward from the front of the lever body 332*a*.

The flat portion 332*c* may be located at the top of the joystick lever 332. The plane portion 332*c* may include a plane inclined downward toward the front.

The lever cap 333 may be coupled to the plane. The lever cap 333 may be formed of rubber material for increasing the friction force. The lever cap 333 may have a thin plate shape.

In addition, the joystick unit 330 further includes a joystick control box 336.

The joystick control box 336 may be coupled to the joystick lever 332 to detect movement by the joystick lever 332.

In detail, the joystick control box 336 may include a box portion 336*a* provided with an electronic device, a box flange 336*b* provided above the box portion 336*a*, and a shaft portion 336*c* extending upward from the center of the upper surface of the box portion 336*a*.

The box portion 336*a* is located below the joystick lever 332. The box portion 336*a* may be received in the inner space 331*d* of the joystick housing 331 while being connected to the joystick lever 332.

The box portion 336*a* provides an internal space in which a plurality of electronic devices are disposed. The box portion 336*a* may be formed in a cylindrical or hexahedral shape.

The box portion 336*a* may include a variable resistance element for detecting a variable resistance value according to the movement of the joystick lever 332.

The box flange 336*b* may be formed at an upper edge of the box portion 336*a*. The box flange 336*b* may further extend outward from an upper surface edge of the box portion 336*a* to be in close contact with the fixing plate 335 which will be described later.

At this time, a fastening hole 336*d* may be formed in the box flange 336*b* to be fastened to the fixing plate 335 by a fastening member. The plurality of fastening holes 336*d* may be spaced apart from each other at the edge of the box flange 336*b*.

The shaft portion 336*c* may extend upward from the center of the upper surface of the box portion 336*a* and be inserted into the joystick lever 332. At this time, the shaft portion 336*c* passes through the opening portion 331*d* of the joystick housing 331 and passes through the bottom surface of the joystick lever 332. In other words, the shaft portion 336*c* may be fixed to move together with the joystick lever 332. The shaft portion 336*c* may be inserted through the lower surface of the lever body 332*a* to the inside of the lever handle 332*b*.

The shaft portion 336*c* can perform a linear movement in the front, rear, left, and right directions, linear movement in the turning direction, and rotation in the circumferential direction while being fixed to the joystick lever 332. To this end, the shaft portion 336*c* may be flexibly coupled to the box portion 336*a*.

By this configuration, when the joystick lever 332 is moved, the shaft portion 336*c* fixed to the joystick lever 332 moves together, and the variable resistance value of the variable resistance element equipped in the box portion 336*a* 336*c* is changed by the movement of the shaft portion. If the variable resistor value is changed, the voltage value input to the analog pin may change accordingly.

In addition, the joystick unit 330 further includes a fixing plate 335.

The fixing plate 335 is a portion to which the joystick control box 336 is fixed. The fixing plate 335 may be disposed above the joystick control box 336. The fixing plate 335 may be disposed in the inner space 331*d* of the joystick housing 331.

For example, the fixing plate 335 may be formed in a square plate shape. The fixing plate 335 may be fixed to the inside of the joystick housing 331. For example, the fixing plate 335 may be fastened by a fastening member to the upper surface 331*a* of the joystick housing 331. The lower surface of the fixing plate 335 may be in close contact with the upper surface of the box flange 336*b*.

A through-hole 335*a* may be formed in the fixing plate 335.

The through-hole 335*a* may be understood as a hole through which the shaft portion 336*c* of the joystick lever 332 passes. The through-hole 335*a* may be formed in a circular shape. The center of the through-hole 335*a* may coincide with the center of the shaft portion 336*c*.

In addition, a fastening hole 335*b* may be further formed in the fixing plate 335.

The fastening hole 335*b* may be disposed at a point corresponding to the fastening hole 336*d* provided in the box flange 336*b*. In other words, a plurality of fastening holes 335*b* may be formed at the peripheral edge of the through-hole 335*a*.

Accordingly, the fastening member may be fastened to the inner side (upper surface) of the joystick housing 331 through the box flange 336*b* and the fixing plate 335.

In addition, the fixing plate 335 may further include a hole 335*c* through which the protrusion portion 331*g* passes.

In other words, when the joystick housing 331 is coupled to the opening portion 255 of the armrest unit 250, the protrusion portion 331*g* can pass through the hole 335*c* and be fastened to the fastening boss 254 formed in the frame body 251. Accordingly, the fixing plate 335 may be firmly fixed without shaking.

In addition, the joystick unit 330 may further include a lever guide 334.

The lever guide 334 is configured to guide the movement of the joystick lever 332 in order to improve the operation feeling of the joystick lever 332. The lever guide 334 may be provided on the bottom surface of the joystick lever 332. The lever guide 334 may be fixed or fitted to the bottom surface of the lever body 332*a*.

Specifically, the lever guide 334 may be formed as a plate formed with a guide hole 334*a* therein. For example, the lever guide 334 may be formed as a plate of a square shape.

The shaft portion 336*c* of the joystick control box 336 may be disposed inside the guide hole 334*a*. In other words, the shaft portion 336*c* may pass through the guide hole 334*a*.

At this time, the center C of the guide hole 334*a* may coincide with the center of the shaft portion 336*c*. The guide hole 334*a* is located above the fixing plate 335. The guide hole 334*a* may be disposed to face the through-hole 335*a* formed in the fixing plate 335. The center C of the guide hole 334*a* may coincide with the center of the through-hole 335*a*.

In addition, a portion of the shaft portion 336*c* may be in contact with the inner surface or the inner circumferential surface of the guide hole 334*a*. In other words, when the joystick lever 332 moves, the shaft portion 336*c* may move together and be restrained on the inner surface of the guide hole 334*a*.

According to the present embodiment, when the joystick lever 332 moves in the initial position, the shaft portion 336*c* may move together and be restrained on the inner surface of the guide hole 334*a*.

At this time, the guide hole 334*a* may be formed in an octagonal shape. In other words, the guide holes 334*a* are vertices a, b, c, d, e, f, g, and h corresponding to the front, rear, left, and right directions, and a diagonal direction (or a turning direction) of the respective directions based on the central axis of the shaft portion 336*c*.

By the configuration of the lever guide 334, the joystick lever 332 and/or the shaft portion 336*c* can be operated not only in four directions, that is, front, rear, front, and rear directions but also in a diagonal direction (or a turning direction) in each direction. Therefore, since the user can operate or move in a total of 8 directions using the joystick lever 332, the operation feeling of the joystick can be improved.

According to the electric wheelchair according to the embodiment of the present disclosure constituting the above configuration, there are the following effects.

First, since the controller can be selectively installed on either armrest unit of the electric wheelchair, there is an advantage that both right-handed and left-handed can be used easily.

Second, the controller is coupled to shield the opening portion formed in the armrest unit and electrically connected to the connector located inside the armrest unit, so that the electric wires connected to the controller are not exposed to the outside. Accordingly, there is an advantage that the outer appearance of the product is beautiful and the electric short circuit due to leakage in rainy weather is prevented in advance.

Third, since the connector disposed inside the armrest unit has a structure that is exposed to the outside through the opening portion, the electric wire of the controller can be easily connected to the connector when the controller is installed. In other words, there is an advantage that the installation of the controller is easy.

Fourth, since the joystick unit, the button part, and the display part are provided in a modular form in the controller, the user can be provided with the information necessary for driving through the display and can drive the electric wheelchair. In other words, the operability and stability of the wheelchair can be improved.

Fifth, since the joystick unit is provided with a lever guide having an octagonal guide hole, the joystick lever can be operated not only in four directions, that is, front, rear, left, and right directions, but also in a diagonal direction (or a turning direction) in each direction. Accordingly, there is an advantage that the operation feeling of the joystick can be improved.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electric wheelchair comprising:

a frame configured to support a seat;

a driver configured to be coupled to a lower portion of the frame;

an armrest configured to be coupled to a side of the frame; and a controller configured to be detachably coupled to the armrest;

wherein the controller is coupled so as to shield an opening formed in the armrest and is electrically connected to a connector located inside the armrest, wherein the controller includes:

a joystick to couple to the armrest;

a button coupled to a front of the joystick, and a display coupled to a front of the button, and wherein the joystick includes:

a joystick housing configured to shield the opening of the armrest;

a control box configured to be disposed in an inner space of the armrest corresponding to an inner side of the joystick housing; and a joystick lever configured to be connected to the control box and disposed outside the joystick housing;

wherein the armrest includes:

a frame body; and a frame cover which is coupled to an upper portion of the frame body and forms the inner space in which the connector is received.

2. The electric wheelchair of claim 1, wherein the frame cover is formed with the opening configured to expose the connector to the outside.

3. The electric wheelchair of claim 1, wherein the frame body is formed with a fastening boss into which a protrusion provided in the controller is inserted.

4. The electric wheelchair of claim 1, wherein the control box includes:

a box configured to be provided with an electronic device;

a box flange configured to be provided above the box; and a shaft configured to extend upward from a center of an upper surface of the box and to be inserted into the joystick lever.

5. The electric wheelchair of claim 4, further comprising:

a fixed plate configured to fix the box flange, wherein the fixed plate is fixed to an inner surface of the joystick housing.

6. The electric wheelchair of claim 5, wherein a through-hole through which the shaft passes is formed on the fixed plate.

7. The electric wheelchair of claim 5, wherein the fixed plate is formed with a hole passing through a protrusion provided in the joystick housing.

8. The electric wheelchair of claim 4, wherein the shaft is inserted into the joystick lever through the joystick housing.

9. The electric wheelchair of claim 4, wherein the joystick housing includes:

an upper surface disposed in the opening of the armrest;

a front surface extending downward from a front end portion of the upper surface; and a pair of side surfaces extending downward from both sides of the upper surface, respectively, wherein an opening through which the shaft passes is formed in the upper surface.

10. The electric wheelchair of claim 9, wherein the joystick housing is formed with a protrusion protruding downward from the inner surface of the upper surface, and wherein the frame body is formed with a fastening boss into which the projection is inserted.

11. The electric wheelchair of claim 4, wherein the joystick lever includes:

a lever body disposed above the opening of the armrest; and a lever handle extending upwardly from the lever body, wherein the shaft passes through the joystick housing and is inserted into the lever handle.

12. The electric wheelchair of claim 11, further comprising:

a lever guide configured to be provided on a bottom surface of the lever body, wherein a guide hole through which the shaft passes is formed in the lever guide.

13. The electric wheelchair of claim 12, wherein the guide hole is made of an octagonal shape, and wherein a central shaft of the shaft and a center of the guide hole correspond to each other.

14. The electric wheelchair of claim 1, wherein the wheelchair is a robot.

15. The electric wheelchair of claim 1, wherein the driver is a robot.

* * * * *